United States Patent [19]

Kiritani et al.

[11] 4,443,535

[45] Apr. 17, 1984

[54] PHOTOGRAPHIC RESIN-COATED PAPER

[75] Inventors: Masataka Kiritani, Shizuoka; Yasuzi Asao, Fujinomiya, both of Japan

[73] Assignee: Fuji Photo Film Co., Ltd., Kanagawa, Japan

[21] Appl. No.: 398,826

[22] Filed: Jul. 16, 1982

[30] Foreign Application Priority Data

Jul. 21, 1981 [JP] Japan ..... 56-114181

[51] Int. Cl.[3] ..... G03C 1/76; G03C 1/86; G03C 3/00

[52] U.S. Cl. ..... 430/538; 106/300; 428/513; 430/536; 427/278; 427/398.2

[58] Field of Search ..... 427/209, 211, 391, 278, 427/398.2; 428/513; 430/536, 538; 106/300

[56] References Cited

U.S. PATENT DOCUMENTS

| | | | |
|---|---|---|---|
| 3,501,298 | 3/1970 | Crawford | 430/538 X |
| 3,758,322 | 9/1973 | Roberts et al. | 106/300 |
| 3,825,438 | 7/1974 | Pritchard et al. | 106/300 X |
| 3,928,057 | 12/1975 | DeColibus | 106/300 |
| 4,179,541 | 12/1979 | Miyama et al. | 427/278 X |

FOREIGN PATENT DOCUMENTS 51-6531 1/1976 Japan .

*Primary Examiner*—Michael R. Lusignan
*Attorney, Agent, or Firm*—Toren, McGeady and Stanger

[57] ABSTRACT

In a photographic resin-coated paper comprising a polyolefin resin layer containing titanium dioxide powder therein and having embossed pattern on the surface, the improvement comprises employment of titanium dioxide powder coated with an alcohol having 2–18 carbon atoms and 2–4 hydroxyl groups as the titanium dioxide powder.

10 Claims, No Drawings

PHOTOGRAPHIC RESIN-COATED PAPER

This invention relates to a photographic resin-coated paper. More particularly, this invention relates to a photographic resin-coated paper comprising a polyolefin resin layer with embossed pattern thereon.

There has been previously employed, as a photographic support, a baryta paper consisting of a paper sheet coated with baryta layer comprising barium sulfate on one surface. Recently, however, a water-proof photographic support consisting essentially of a paper sheet coated with hydrophobic polyolefin resin on both surfaces thereof has been developed and employed to cope with the requirement for rapid development process, replacing the conventional baryta paper.

The polyolefin resin-coated paper, as described above, generally consists of a paper sheet coated with polyolefin resin. In the polyolefin resin layer placed on one surface of the paper sheet on which a photographic emulsion layer is to be placed, there is generally contained titanium dioxide powder (pigment) for providing high whiteness and high screen to the paper.

As the titanium dioxide powder employable for the above-mentioned purpose, well known are simple titanium dioxide powder and titanium dioxide powders treated or coated with inorganic substance such as silica or alumina.

Among the polyolefin resin-coated papers, there is known a polyolefin resin-coated paper comprising a polyolefin resin layer containing titanium dioxide powder therein and having embossed pattern on the surface, for instance, a polyolefin resin-coated paper with silk surface. The embossed pattern is generally produced by pressing a patterning roll or the like onto the polyolefin resin layer containing titanium dioxide powder.

The reproduction of an embossed pattern on the polyolefin resin layer containing the conventional titanium dioxide powder, however, is apt to fail to produce a close copy of the pattern. Although the reason why such difficulty occurs in the procedure is not known, the following reasons are hypothetically thought: the polyolefin resin layer surface cannot be in close contact with the patterning roll surface when the roll is pressed against the resin surface; the polyolefin resin surface somewhat returns to the previous state to become a relatively flat surface after removal of the patterning roll; and/or the titanium dioxide powder is unevenly dispersed in the polyolefin resin layer, resulting in the partial resistance to the patterning (embossing).

If the finely etched pattern is not reproduced on the polyolefin resin layer surface, the resulting resin-coated paper does not provide uniform surface. A photographic material prepared by placing a photographic emulsion on the resin-coated paper with non-uniform surface disadvantageously gives uneven image with local glitter.

Accordingly, a principal object of the invention is to provide a photographic resin-coated paper comprising a polyolefin resin layer containing titanium dioxide powder therein and having sharply embossed pattern on the surface.

Another object of the invention is to provide a photographic resin-coated paper comprising a polyolefin resin layer containing titanium dioxide powder therein and having evenly embossed pattern on the surface.

Other objects of the invention will be seen in the description given below.

The objects of the invention are accomplished by the improvement comprising employment of titanium dioxide powder coated with an alcohol, preferably, an aliphatic alcohol, having 2–18 carbon atoms and 2–4 hydroxyl groups as the titanium dioxide powder.

The reason why the employment of titanium dioxide powder coated with the above-specified polyhydric alcohol is effective for providing sharply and evenly embossed pattern on the polyolefin resin layer surface is not precisely known. However, the reason is thought as follows:

The polyolefin resin containing the titanium dioxide powder coated with the specifically selected polyhydric alcohol is improved in the fluidity even in the microscopic phase and reduced in the restoration tendency in comparison with the polyolefin resin containing the conventional untreated or inorganic material-coated titanium dioxide powder. These effects and improved dispersability of the titanium dioxide powder in the polyolefin resin probably cooperate together to assist the production of the well qualified embossed-pattern on the polyolefin resin layer surface.

Preferred embodiments of the invention are now described hereinafter.

In the invention, there is no limitation on the titanium dioxide powder, as far as it is applicable to incorporation into a polyolefin resin layer of a photographic paper. For instance, rutile $TiO_2$ powder or anatase $TiO_2$ powder ranging in particle size of 0.1–5 microns is employed. The titanium dioxide powder may be coated with inorganic material such as silica or alumina, or may be treated with an adequate material.

Among these pre-coated or pre-treated powders, anatase-type titanium dioxide powder coated in advance with hydrated alumina in the amount less than 0.5% by weight of the powder is preferred, because it provides, after coating with the polyhydric alcohol, prominently sharp pattern, reduces yellowing with the passage of time of the prepared photographic resin-coated paper, and improves the resolution of the photographic material prepared therefrom.

Examples of the polyhydric alcohol having 2–18 carbon atoms and 2–4 hydroxyl groups employable in the invention include: alcohols containing 2 hydroxyl groups in the molecule such as ethylene glycol, propylene glycol, 1,3-dihydroxybutane, 1,4-dihydroxybutane, pentamethylene glycol, 2,5-dihydroxyhexane, 2,4-dihydroxy-2-methylpentane, heptamethylene glycol, and dodecamethylene glycol; alcohols containing 3 hydroxyl groups in the molecule such as trimethylolethane, trimethylolpropane, glycerol, 2,4-dihydroxy-3-hydroxymethylpentane, 1,2,6-hexanetriol, and 2,2-bis(-hydroxymethyl)-3-butanol; and alcohols containing 3 hydroxyl groups in the molecule such as pentaerythritol.

Alcohols containing only one hydroxyl group in the molecule, and polyhydric alcohols containing 5 or more hydroxyl groups are ineffective for the production of satisfactory qualified embossed-pattern.

In the invention, the polyhydric alcohol for coating the titanium dioxide powder preferably contains 2–6 carbon atoms and 2–4 methylol groups. More preferably, the polyhydric alcohol contains 4–5 carbon atoms and 3 methylol groups. Particularly, titanium dioxide powder coated with trimethylolethane is highly effective for the production of well qualified embossed pattern.

The polyhydric alcohol is preferably coated over the surface of the titanium dioxide powder in the amount of approximately 0.01–10% by weight of the titanium dioxide powder. Particularly preferred range of the coating amount is approximately 0.1–1.5% by weight of the same. The polyhydric alcohol less than 0.01% by weight is not able to improve the quality of pattern embossed on the polyolefin layer surface. The polyhydric alcohol more than 10% by weight may be effective for the production of the sharply embossed pattern, but the polyhydric alcohol coated on the powder in such a large amount causes increased emitting of smoke and offensive odor in melt extrusion process for the preparation of the polyolefin resin-coated paper, resulting in deterioration of the working atmosphere.

The coating of the titanium dioxide powder with the polyhydric alcohol can be accomplished in a variety of ways. Examples of the coating procedures include: a procedure comprising immersing the titanium dioxide powder in a solvent containing the polyhydric alcohol, recovering the powder from the solution, and removing the solvent from the so recovered titanium dioxide powder through volatilization; a procedure comprising spraying a solvent containing the polyhydric alcohol over the titanium dioxide powder, and removing the solvent from the powder through volatilization; a process comprising mixing a molten polyhydric alcohol with the titanium dioxide powder; and a process comprising pulverizing solid titanium dioxide in the presence of the polyhydric alcohol. Industrially preferred processes are a process comprising pulverizing the titanium dioxide in a hydrodynamic pulverizer such as a micronizer or a jet mill under adding the polyhydric alcohol; and a process comprising mixing the titanium dioxide powder with the polyhydric alcohol in a high shearing mixer such as a Henschel mixer or a super mixer.

The titanium dioxide powder coated with the polyhydric alcohol is incorporated into a polyolefin resin generally in the amount of approximately 1–40% by weight, preferably 5–20% by weight, of the resin.

In the invention, the polyolefin resin preferably has melt index (MI) in the range of 1–40 g./10 min., more preferably 5–30 g./min. This melt index value is determined in accordance with the measurement procedure defined in JIS K 6760–1966.

Examples of the polyolefin resins of the invention include ethylene homopolymers such as high density polyethylene and low density polyethylene, propylene homopolymers and copolymers of ethylene with one or more copolymerizable monomers. When the ethylene copolymer is selected, the copolymerizable monomer preferably amounts to not more than 10% by weight of the ethylene content. Examples of the copolymerizable monomers include alfa-olefins such as styrene, vinyl stearate, vinyl acetate, acrylic acid, methyl acrylate, ethyl acrylate, acrylamide, methacrylic acid, methyl methacrylate, ethyl methacrylate, methacrylamide; and diene compounds such as butadiene and isoprene. The polyolefin resin can be employed alone or in combination.

Incorporation of the titanium dioxide powders coated with the polyhydric alcohol into the polyolefin resin can be carried out by a conventional method such as the melt extrusion process using a kneading extruder, a heating roll mill, a Banbury mixer, or a kneader.

Preferably, the incorporation of the coated titanium dioxide powder into the polyolefin resin is carried out through preparation of a master batch. More in detail, the coated titanium dioxide powder is incorporated into the polyolefin resin in the amount of approximately 10–60% by weight, preferably 20–40% by weight, of the resin. The so prepared polyolefin resin composition containing a large amount of the coated titanium dioxide powder is diluted with a simple polyolefin resin when subjected to the melt extrusion.

The polyolefin resin composition may further contain a variety of additives such as fluorescent whitening agent, antioxidizing agent, antistatic agent, releasing agent, dye and dispersing agent, if desired.

The polyolefin resin composition containing the titanium dioxide powder coated with the polyhydric alcohol and, if desired, one or more additives, is then coated over a surface of a paper sheet through melt extrusion. In the present specification, the (melt) extrusion means a procedure comprising coating a running apper sheet with polyolefin resin composition in the form of film extruded in molten state through a slit die from an extruder. In the procedure, the polyolefin resin composition is in molten state under heating to approximately 250°–350° C., preferably 280°–320° C. The paper sheet is running at a rate of approximately 50–500 m/min., preferably 80–250 m/min. Examples of the slit dies include flat dies such as T-die, L-die and fishtail dye. The slit gap preferably ranges from approximately 0.1 to 1.5 mm.

The polyolefin resin layer can be composed of two or more layers.

There is no limitation on material of the paper sheet, as far as the material is able to serve as support of a photographic material. Examples of the materials of the paper sheet include natural pulp, synthetic pulp, and their mixtures. The thickness of the paper sheet generally ranges from approximately 20$\mu$ to approximately 400$\mu$, and preferably ranges from 70$\mu$ to 250$\mu$. The basis weight of the paper sheet generally ranges from approximately 15 g./m$^2$ to approximately 350 g./m$^2$, and preferably ranges from 50 g./m$^2$ to 200 g./m$^2$. The paper sheet may contain conventional agents such as paper strength increasing agent, sizing agent, dye, fluorescent whitening agent, a preserving agent, filler and antistatic agent, if desired.

Representative methods for the production of embossed pattern on the resin-coated include a method using an embossing calendar having projections or depressions of 40 microns to 2 mm high (deep), and a method using a cooling roll having engraved pattern on the surface. The cooling roll is generally employed in conjunction with the extrusion coating procedure. The latter method, namely, the method using the cooling roll is advantageous, because the pattern is easily reproduced on the polyolefin resin layer surface at relatively low pressure. Moreover, this method enables to produce very sharp embossed-pattern on the layer at higher speed. Accordingly, the method using the cooling roll is preferably adopted for the preparation of the photographic resin-coated paper of the invention.

The cooling roll preferably has the finely distributed projections or depressions, or the engraved pattern of the depth of not more than 40 microns on the surface. The depth preferably is 2 to 30 microns, and more preferably 10 to 25 microns. Matte producing process is preferably applied to the engraved roll surface, because the reproduction of remarkably sharp embossed-pattern on the resin layer surface can be readily attained due to easier escape of air retained on the engravement.

The matte producing process can be carried out through sand-blasting to give the roughness of about 2 to about 5 microns deep onto the engraved roll surface.

The reproduction of the engraved pattern on the polyolefin resin layer containing the titanium dioxide powder coated with the aforementioned specific polyhydric alcohol is carried out by means of the cooling roll, the depth of the engraving is perfectly reproduced so that the pattern embossed on the polyolefin resin layer has almost the same depth as the engraving of the roll surface.

The thickness of the polyolefin resin layer should be adjusted to not less than 1.1 times, particularly not less than 1.2 times, of the depth of the engraving provided on the roll surface, if an evenly reproduced pattern is desired. In a theoretical sense, the lower limit of the thickness of the polyolefin resin layer is 1.0 time of the engraving depth. But, if the thickness is equal to the engraving depth, the satisfactory reproduction of the engraved pattern cannot be accomplished in practice. There is no specific upper limit on the thickness of the resin layer. However, in view of the material cost, the thickness of the resin layer should be, at most, 5 times of the engraving depth.

The cooling roll with the engraved pattern is applied onto the surface of the polyolefin resin layer under notsolidified, relatively soft conditions. Accordingly, the pressure for the patterning can be so reduced as a pressure of not more than about 30 kg./cm, specifically, 25 to 10 kg./cm.

The period for the pressing can be about 5 seconds or shorter and, for instance, a period of not longer than 1 second can be generally chosen. The pressing period may vary according to the temperature of the extruded resin, the temperature of the cooling roll, and other factors.

The present invention is now illustrated by the following examples, but these examples by no means restrict the invention.

EXAMPLES

A paper sheet (LBKP 100%, basis weight: 175 g./m$^2$, thickness: 180$\mu$) was coated with polyethylene (density: 0.920 g./cc., MI: 5.0 g./10 min.) containing a titanium dioxide powder in the amount of 10% by weight of the polyethylene, through melt extrusion to produce a polyethylene coating layer of thickness of 30$\mu$. In the melt extrusion process, a cooling roll having silky-pattern engraved surface (depth of the engraving: 25 microns) was pressed onto the extrusion-coated polyethylene layer to reproduce on the resin surface the embossed pattern corresponding to the engraved pattern of the roll surface.

The titanium dioxide powders employed in the examples were as follows:

(A) simple anatase-type titanium dioxide powder;

(B) anatase-type titanium dioxide powder coated with 2,4-dihydroxy-2-methylpentane in the amount of 0.5% by weight of the powder prepared by immersing the titanium dioxide powder in ethanol containing 2,4-dihydroxy-2-methylpentane, recovering it from the ethanol solution, and drying the recovered powder to remove the ethanol;

(C) anatase-type titanium dioxide powder coated with trimethylolpropane in the amount of 0.5% by weight of the powder prepared by pulverizing a mixture of trimethylolpropane and titanium dioxide in a jet mill;

(D) anatase-type titanium dioxide powder coated with trimethylolethane in the amount of 0.5% by weight of the powder prepared by pulverizing a mixture of trimethylolethane and titantium dioxide in a jet mill; and (E) anatase-type titanium dioxide powder treated preliminarily with hydrated alumina and then coated with trimethylolethane in the amount of 0.5% by weight of the powder by pulverizing a mixture of trimethylolethane and the pretreated titanium dioxide powder in a jet mill.

The so prepared photographic resin-coated papers with the embossed pattern on the polyolefin resin layer were observed microscopically. The results of the microscopic observation are set forth in Table 1.

TABLE 1

| Sample | Conditions of Embossed Pattern | Depth of Embossed Pattern |
|---|---|---|
| A | Uneven | 14–24$\mu$ |
| B | Even | 18–24$\mu$ |
| C | Even | 20–24$\mu$ |
| D | Even | 20–24$\mu$ |
| E | Even | 21–24$\mu$ |

The photographic resin-coated papers A through E were then processed by the application of corona discharge so that the surfaces of the resin layers were made relatively hydrophilic. On each of the so processed resin surface was placed a conventional photographic emulsion.

The so prepared photographic materials were exposed to light and then developed to produce a visible image thereon.

The photographic material prepared from the photographic paper A showed relatively uneven visible image with some local glittering.

The photographic materials prepared from the photographic papers B through E showed well-qualified glossy visible images with no glittering.

We claim:

1. In a photographic resin-coated paper comprising a polyolefin resin layer containing titanium dioxide powder therein and having embossed pattern on the surface, the improvement comprises employment of titanium dioxide powder coated with an alcohol having 2–18 carbon atoms and 3 methylol groups as the titanium dioxide powder.

2. The photographic resin-coated paper as claimed in claim 1, in which the alcohol contains 2–6 carbon atoms.

3. The photographic resin-coated paper as claimed in claim 1, in which the alcohol contains 4–5 carbon atoms.

4. The photographic resin-coated paper as claimed in claim 1, in which the alcohol is trimethylolethane.

5. The photographic resin-coated paper as claimed in claim 1, in which the alcohol is coated over the titanium dioxide powder in the amount of about 0.01 to about 10 percent by weight of the titanium dioxide powder.

6. The photographic resin-coated paper as claimed in claim 1, in which the alcohol is coated over the titanium dioxide powder in the amount of about 0.1 to about 1.5 percent by weight of the titanium dioxide powder.

7. The photographic resin-coated paper as claimed in claim 1, in which the titanium dioxide powder is coated with inorganic material in advance of the coating of the alcohol.

8. The photographic resin-coated paper as claimed in claim 7, in which the inorganic material is silica or alumina.

9. The photographic resin-coated paper as claimed in claim 1, in which the polyolefin resin is polyethylene resin.

10. A method for producing an embossed pattern on a surface of a photographic resin-coated paper comprising a polyolefin resin layer containing titanium dioxide powder therein by means of a cooling roll with an engraved pattern on the surface, which is characterized by employment of titanium dioxide powder coated with an alcohol having 2–18 carbon atoms and 3 methylol groups as the titanium dioxide powder.

* * * * *